United States Patent [19]

Johnson et al.

[11] 3,973,367

[45] Aug. 10, 1976

[54] ROOF STRUCTURE WITH MEANS TO RESIST LATERAL FORCES

[75] Inventors: Donald L. Johnson, Independence; Donald L. Broyles, Raytown; Gregory J. Stervinou, Kansas City; Barton Bigge, Independence; David Reynolds, Kansas City, all of Mo.

[73] Assignee: Butler Manufacturing Company, Kansas City, Mo.

[22] Filed: Feb. 13, 1975

[21] Appl. No.: 549,696

Related U.S. Application Data

[63] Continuation-in-part of Ser. No. 444,285, Feb. 21, 1974, abandoned.

[52] U.S. Cl. ..... 52/262; 52/15; 52/92; 52/483; 52/573

[51] Int. Cl.[2] ..... E04B 7/00; E04D 13/00

[58] Field of Search ..... 52/261, 262, 263, 92, 52/90, 91, 537, 521, 573, 732, 283, 48, 483, 15

[56] References Cited

UNITED STATES PATENTS

| | | | |
|---|---|---|---|
| 1,085,862 | 2/1914 | Herzberg et al. | 52/584 X |
| 2,331,483 | 10/1943 | Lawman et al. | 52/262 X |
| 2,364,528 | 12/1944 | Heinrich | 52/394 X |
| 2,387,229 | 10/1945 | Auten | 52/263 |
| 2,684,134 | 7/1954 | Ruppel | 52/262 |
| 2,710,584 | 6/1955 | Ross | 52/91 |
| 2,887,192 | 5/1959 | Schaub et al. | 52/488 |
| 3,084,479 | 4/1963 | Struben | 52/90 X |
| 3,309,829 | 3/1967 | Berridge | 52/573 X |
| 3,488,899 | 1/1970 | Schultz et al. | 52/90 X |
| 3,611,661 | 10/1971 | Chambers et al. | 52/94 |
| 3,662,509 | 5/1972 | Studzinski | 52/483 X |
| 3,676,973 | 7/1972 | Kellert | 52/573 X |
| 3,796,014 | 3/1974 | Garbrick | 52/90 X |
| 3,820,295 | 6/1974 | Folley | 52/90 X |
| R20,980 | 1/1939 | McMillan | 52/261 |

FOREIGN PATENTS OR APPLICATIONS

| | | | |
|---|---|---|---|
| 723,349 | 12/1965 | Canada | 52/261 |
| 1,477,830 | 3/1967 | France | 92/ |
| 1,256,007 | 2/1961 | France | 52/90 |
| 2,162,346 | 7/1972 | Germany | 52/263 |

*Primary Examiner*—Ernest R. Purser
*Assistant Examiner*—Leslie A. Braun
*Attorney, Agent, or Firm*—Shoemaker and Mattare, Ltd.

[57] ABSTRACT

A roof structure for a building having a non-rigid type frame, in which the roof structure includes roof panels secured to a secondary frame, the secondary frame being secured to a primary frame which is, in turn, secured to the walls of a building, and braces connected to the secondary frame so that lateral forces imposed on the side walls of the building are transmitted through the primary frame to the secondary frame and thence to the roof panels, said panels thus transferring the lateral forces imposed on the side walls of the building to the shear resisting walls or structure at the ends of the building.

13 Claims, 10 Drawing Figures

ROOF STRUCTURE WITH MEANS TO RESIST LATERAL FORCES

This application is a continuation-in-part of application Ser. No. 444,285, filed Feb. 21, 1974, now abandoned.

BACKGROUND OF THE INVENTION

In building construction, it is often advantageous to utilize the lightweight roof panels in the roof as a structural element or diaphragm in resisting lateral forces on the walls of the building. This is particularly important in buildings of the type having a non-rigid frame, and wherein metal roof panels are used, as for example in wide buildings or when load bearing concrete walls or the like are used, or for braced walls or post and beam structures. In wide buildings, there are of necessity several lengths of roof panels on the roof, and in order to properly handle thermal expansion and contraction, the roof panels, when made of metal, have cooperating structure such as slotted holes at one of their ends to allow for endwise slippage between adjacent panels and between the panels and a portion of the secondary framing of the building. Obviously, such structure in the prior art eliminates the effectiveness of the roof panel or panels in resisting lateral forces on the building.

Moreover, in wide building designs wherein load bearing walls or the like are used and where interior gutters and the like are used and the roof panels thus cannot be attached to the wall or other vertical load carrying member, the panels of the roof are not effective to resist lateral forces on the building.

The above problems are particularly acute when light gauge steel roof panels are connected to a secondary frame such as Z purlins which are, in turn, secured to roof beams, as is typical in most metal, pre-engineered buildings. Because of the simplicity, economy of design, and ruggedness and durability of metal, pre-engineered buildings utilizing light gauge steel roof panels secured to a secondary frame which is, in turn, secured to a primary frame in a building construction, some means in the roof structure of enabling the roof structure to resist lateral forces on the building is highly desirable.

The present invention provides a roof construction in which a secondary framework is attached to a primary frame of the building and a plurality of roof panels are attached to the secondary framework, and wherein brace means or shear connectors are connected between a predetermined number of the elements of the secondary framework such that the entire roof structure is rigidified and lateral forces are thus enabled to be transferred from the side walls of the building through the primary frame and secondary frame and into the panels of the roof structure, which effectively transfer these forces to the end shear walls or other rigid structure at the ends of the building.

More particularly, the present invention relates to a metal, pre-engineered building construction in which light guage steel roof panels are attached to a secondary frame comprising a plurality of Z purlins, which are attached to the roof beams of the primary frame of the building. With the roof construction of the present invention, interior gutters may be used without deteriorating the effectiveness of the roof panels in resisting lateral forces on the building, and wide building construction may be used wherein more than one panel is connected in end-to-end relationship, with slotted holes for thermal expansion and contraction provided therebetween. The invention is equally as effective when exterior gutters, or other arrangements, are utilized in the building construction.

Specifically, the present invention comprises a channel-shaped brace that is connected between two adjacent purlins of a roof structure, with one brace for each length of roof panel and with the brace positioned substantially centrally of an associated roof panel. The brace thus prevents rotation of the purlins about their longitudinal axis and thereby rigidifies the roof structure and eliminates the need for structural attachment of the roof panels to the wall members or elements of the building construction, except at the end wall of the building where gutters are not normally required. In effect, each roof panel acts as a diaphragm to resist lateral forces, and yet the provision for thermal expansion and contraction is not adversely affected. The roof is comprised of individual diaphragms that are as wide as each roof panel is long.

The present invention also allows the use of metal roof panel, Z purlin construction, with load bearing, precast or tilt up wall panels, and the invention allows the transfer of the load from the purlins into the panels without affecting provisions for expansion and contraction of the panels, and also eliminates the need for expensive bracing of the building construction, such as cross bracing rods and the like.

OBJECT OF THE INVENTION

It is an object of this invention to provide a roof structure with means to resist lateral forces on a building on which the roof structure is provided, and wherein the roof structure includes a plurality of secondary frame members attached to the primary frame of the building, and with a plurality of roof panels attached to and carried by the secondary frame members, said secondary frame members being braced and rigidified such that lateral forces on the walls of the building are transferred through the primary frame and secondary frame members into the roof panels, which transfer the load to rigid end wall structures, and the end wall structures thus act in shear to resist the loads.

DETAILED DESCRIPTION OF THE INVENTION

Figure 1:
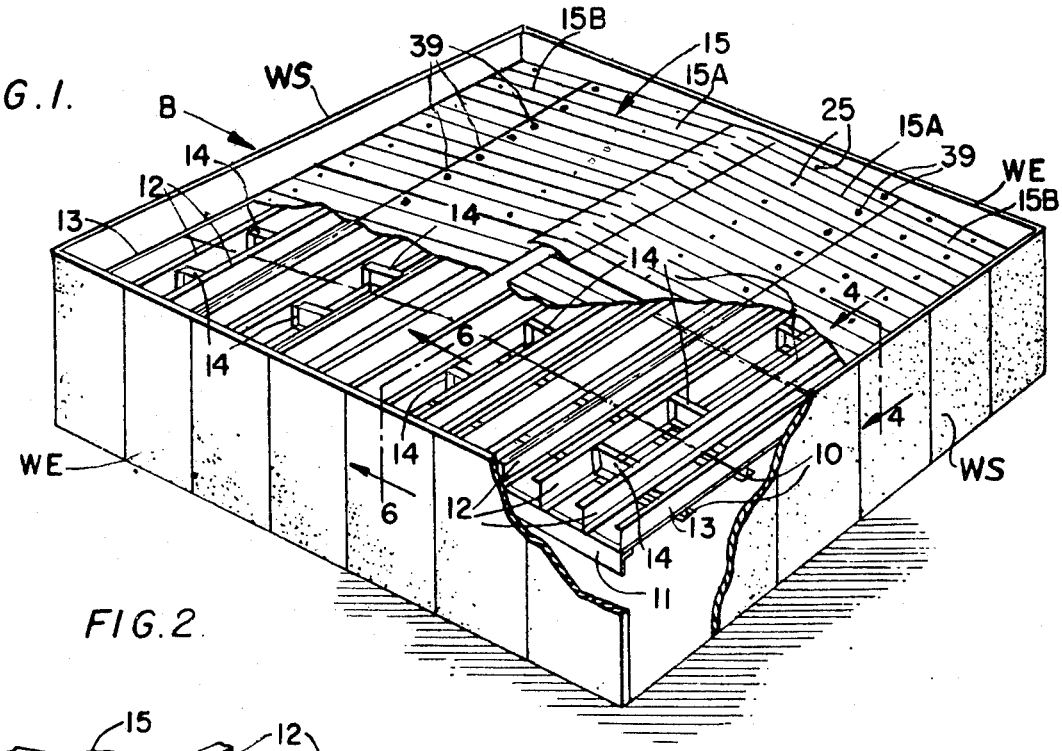
FIG. 1 is a top perspective view, with portions broken away, of a building having a roof structure in accordance with the invention thereon.

In the drawings, wherein like reference numerals indicate like parts throughout the several views, a building B of substantially conventional, concrete, shear wall construction includes a plurality of load bearing, concrete side walls WS and a plurality of rigid, shear resisting end walls WE. The building also includes a primary frame having a plurality of spaced apart, transversely extending H-section roof beams 10 and wall support angles 11 at opposite ends of the building. A plurality of spaced apart, substantially parallel, longitudinally extending Z purlins 12 are attached to and supported on the roof beams 10, and an eave strut 13 is supported on the primary frame at opposite sides of the building. A plurality of elongate, channel-shaped, shear connectors or roof braces 14 are connected at their opposite ends between selected Z purlins for rigidifying the roof structure, and a plurality of roof panels 15 are attached to and supported on top of the Z purlins. The arrangement of braces 14 and roof panels 15 is such that a roof brace is provided substantially centrally of each panel. As seen in FIG. 1, for example, a brace 14 is provided for each roof panel 15, so that lateral forces such as wind loads and the like imposed on the side walls WS of the building B are transferred from the walls to the primary frame and thence into the secondary frame and to the roof panels 15, which transfer the loads to the shear resisting end walls WE, whereby the lateral forces on the building are resisted. The braces 14 prevent rotation of the Z purlins about their longitudinal axes, and thus each roof panel acts as a diaphragm to transfer loads. In effect, the roof is composed of individual diaphragms that are as wide as the roof panel is long, and each roof panel independently handles thermal expansion and contraction. The roof structure is rigidified so that it is enabled to effectively transfer the lateral loads to the end walls and thus withstand or resist the lateral forces imposed on the building, while at the same time it permits thermal expansion and contraction of the panels.

Figure 2:
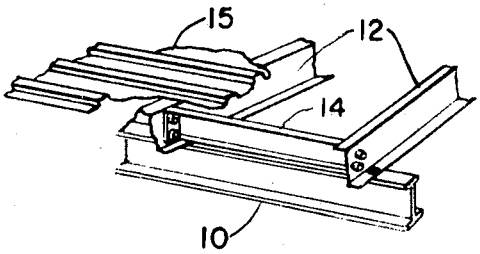
FIG. 2 is a greatly enlarged, perspective, fragmentary view of a portion of the roof structure of FIG. 1, showing the shear channel or brace according to the invention.
Figure 3:
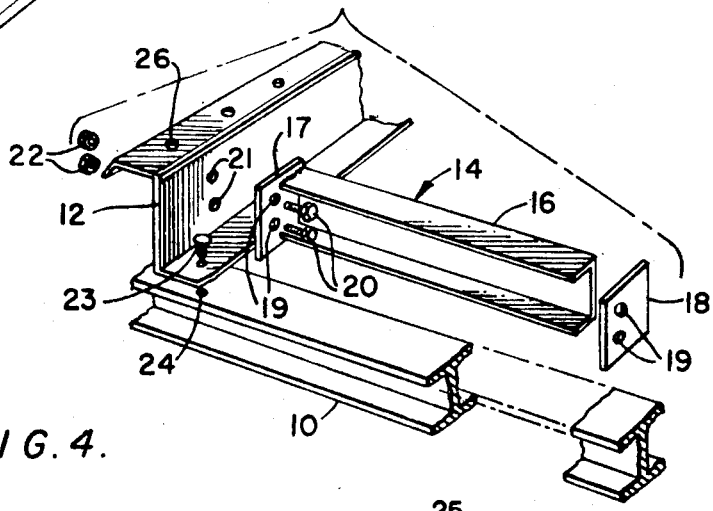
FIG. 3 is a greatly enlarged, fragmentary, perspective, exploded view of a portion of the primary and secondary frame members and a brace for the roof structure of FIGS. 1 and 2.
Figure 4:
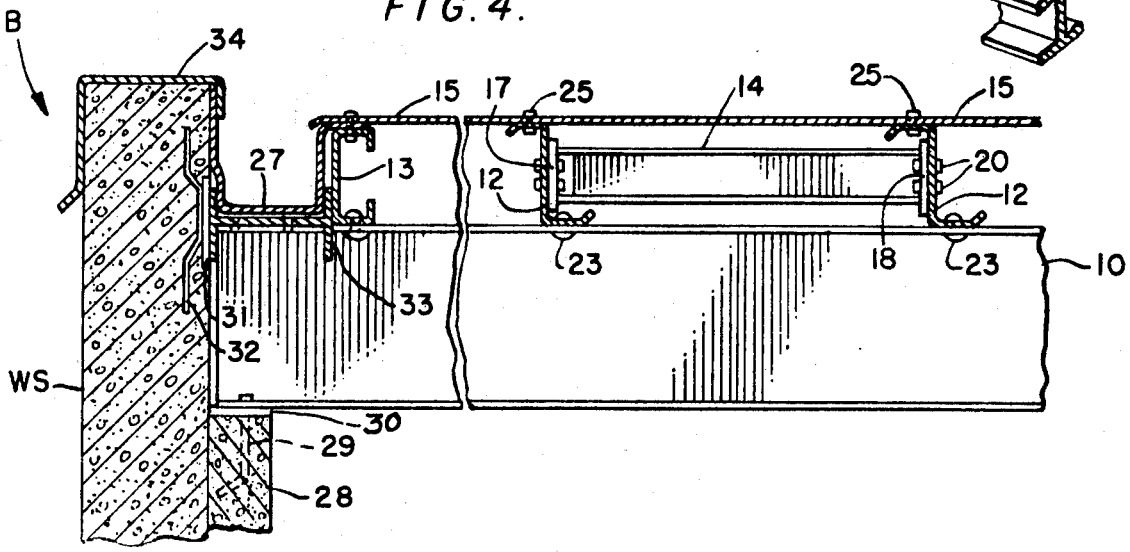
FIG. 4 is an enlarged, fragmentary, vertical sectional view taken on line 4—4 of FIG. 1.

As seen in FIGS. 2, 3 and 4, each brace 14 includes an elongate, channel-shaped member 16, having end plates 17 and 18 welded to the opposite ends thereof, and each end plate has a pair of vertically spaced apart holes 19 therethrough through which suitable fastening means, such as bolts 20 or the like, may be extended for reception through aligned openings 21 in the central web or side of a Z purlin 12 for attachment thereto of nuts 22 to secure the end plates and thus the braces 14 to respective adjacent purlins 12. The purlins are secured to the beams 10 in any suitable manner as, for example, by means of bolts 23 or the like, extended through the bottom flange portion of the purlin and through an aligned hole 24 in the top flange of the beam 1. The roof panels 15 are attached to the upper flange of the purlins 12 by means of suitable fasteners, such as a blind fastener or the like 25, extended through the roof panels and through aligned openings 26 in the top flange of the purlin 12. Each brace 14 is positioned in substantial vertical alignment with a beam 10 and in parallel relationship thereto, and a brace is connected between a pair of purlins, such that the brace is positioned substantially centrally of a roof panel 15. Accordingly, each brace is effective to prevent rotation of the purlins associated with a roof panel, and yet adjacent roof panels are enabled to move relative to one another to compensate for thermal expansion and contraction of the roof panels.

In a typical wide building construction, the purlins are placed approximately five feet apart and the roof panels comprise 24 gauge galvanized steel. The roof panels are attached to the purlins on 12 inch centers and are fastened to each other on 30 inch centers. However, these specific values are for example only and other dimensions could be used, depending on the particular construction employed. For example, in FIG. 7, a double slope roof is shown, and the panels extending to the crest or ridge of the roof are 30 feet long, while the panels extending to the side walls WS are 35 feet long.

In FIG. 4, a typical building construction is shown, wherein an interior gutter 27 is provided and, accordingly, the roof panels 15 cannot be attached directly to the side walls WS. In this structure, the beam 10 is supported at its end on a pilaster 28 and is suitably secured or anchored thereto by means of an anchor bolt 29 extended through the flange of the beam 10 and into the pilaster 28. Suitable grout 30 is provided between the end of the beam and the pilaster 28. A plate 31 is embedded in the concrete of the wall and is exposed at the inner surface thereof and is anchored to the wall by means of a tie rod or anchor member 32, which is embedded within the concrete and welded or otherwise suitably secured to the plate 31. A side wall girt 33 of substantially H-shaped cross section is secured to the plate 31, and the eave strut 13 is attached to the side wall girt 33, with the gutter 27 being nested within the space provided between the upwardly extending flanges of the side wall girt 33. Suitable cap or flashing 34 may be provided over the upper edge of the wall W, if desired. As seen in this Figure, the roof panel 15 is free of attachment with the side wall WS, but because of the brace 14 connected between the adjacent purlins 12, the purlins are not permitted to rotate about the longitudinal axes and the roof structure is thus rigidified so that lateral forces imposed on the wall WS and transmitted to the primary frame comprising beam 10 is transferred to the purlins 12 and thence to the roof panels 15, which transfer the lateral forces imposed on the side walls WS to the end walls WE.

Figure 5:
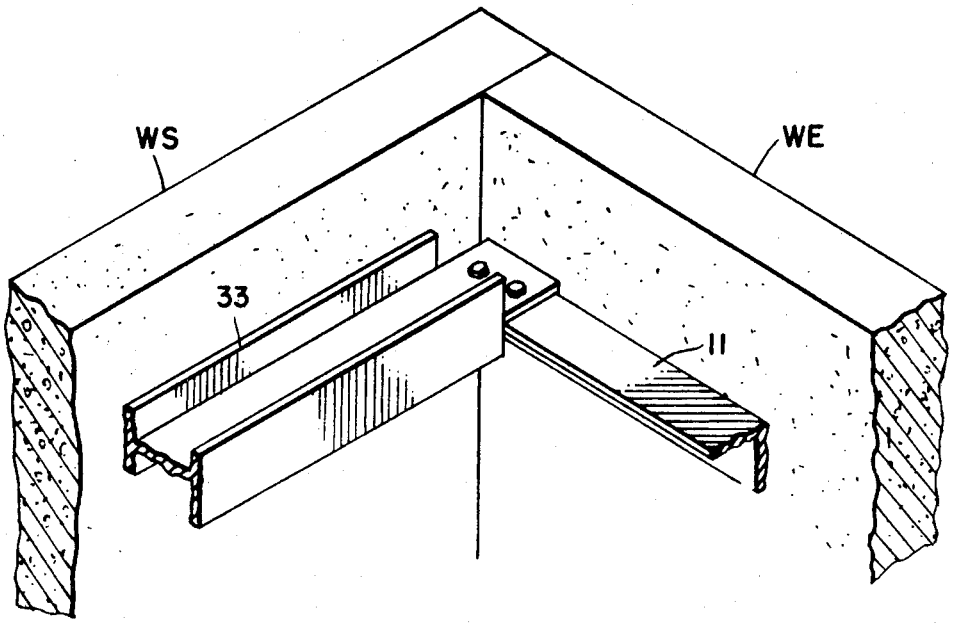
FIG. 5 is an enlarged, fragmentary, perspective view of a corner of the building of FIG. 1, showing the relationship of side wall girt and end wall angle.

In FIG. 5, the arrangement of side wall girt 33 and end wall angle 11 is clearly shown, and the purlins 12 and other structure are left off for clarity.

Figure 6:
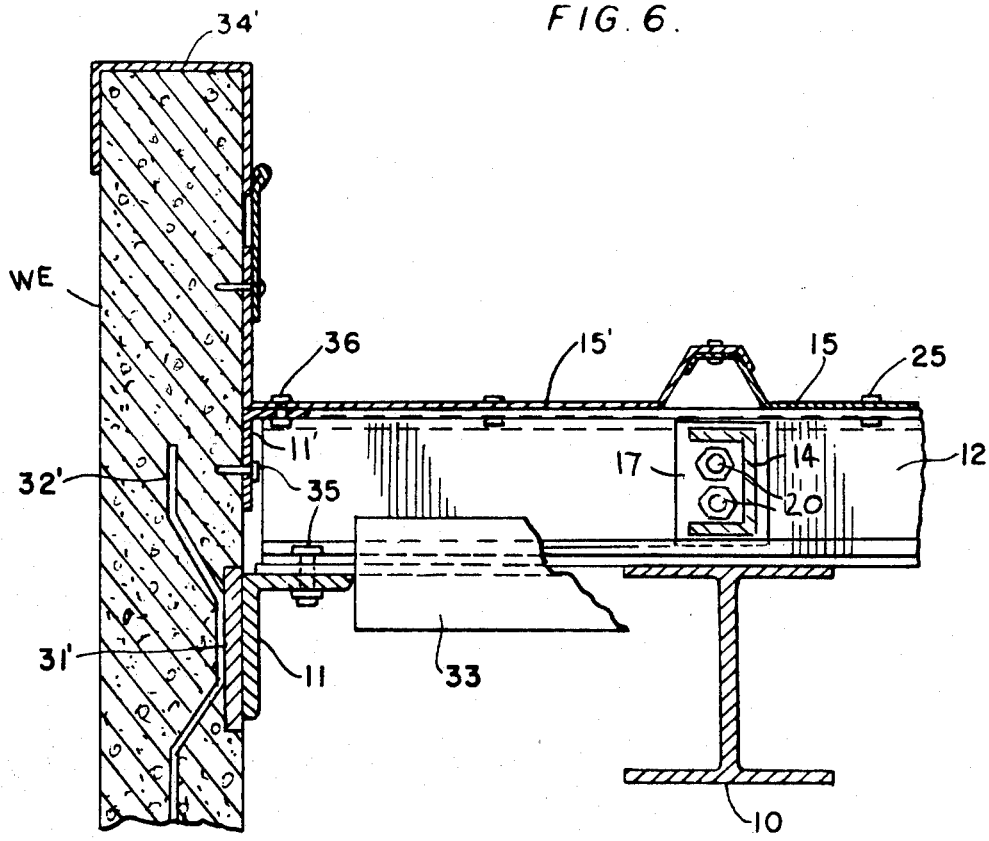
FIG. 6 is an enlarged, fragmentary sectional view taken on line 6—6 of FIG. 1.

In FIG. 6, the details of connection of the wall angle 11, girt 33, purlins 12 and roof panels 15 to each other and to the end wall WE are clearly shown. The wall angle 11 is secured as by a weld or bolts or the like to a plate 31' embedded in the wall WE and anchored thereto by tie rod or anchor 32'. The end of purlin 12 is suitably secured to the top flange of angle 11 as by bolts 35 or the like, and is also suitably secured to the horizontal flange of an upper or gable angle 11' also suitably secured to the wall by anchor bolts 35 or the like. An endmost roof panel 15' is suitably secured to the purlin 12 and to the gable angle 11', as by means of anchor bolts 36 or the like. Thus, lateral forces imposed on side walls WS are transferred to primary frame 10, through secondary frame 12 and 14, into the roof panels 15 and 15', and thence into the end walls WE, which act as shear walls and accordingly resist the lateral forces imposed on the building through the side walls WS.

Of course, the invention is equally as well applied to other types of building constructions which do not have an interior gutter as shown, and different types of wall girts and corner connections between the frame members can be used.

Figure 7:
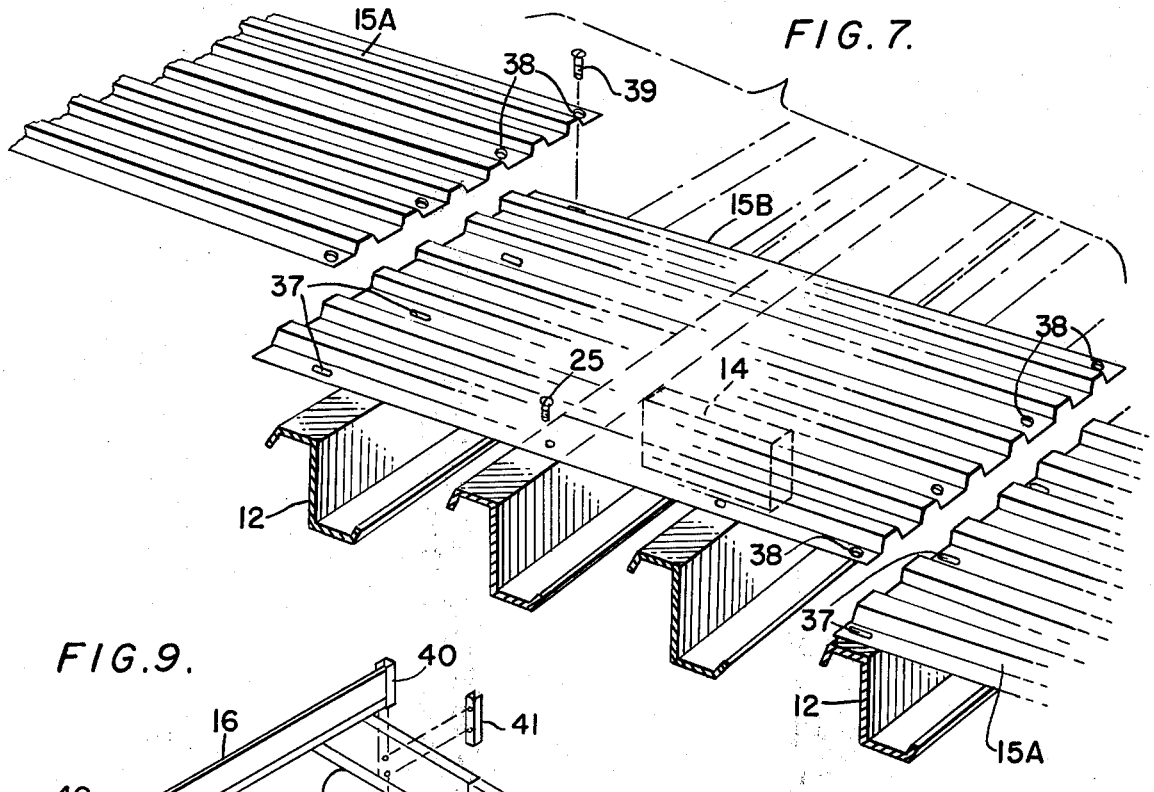
FIG. 7 is an enlarged, fragmentary, perspective view of the manner in which the roof panels are connected to the secondary frame members and showing the relationship of the brace and expansion means therewith.

In FIG. 7, the means for enabling the roof panels to independently handle thermal expansion and contraction is clearly shown, and comprises a plurality of slotted holes 37 in one end of each panel and a plurality of round holes 38 in the other end of each panel, with suitable fastening means, such as the blind fasteners 25 or bolts 39, or the like, extended through the slotted holes 37 in one end of a panel 15A and the round holes 38 in an adjacent, overlapped end of another panel 15B and into the upper flange of the underlying purlin 12. Each panel 15A and 15B is fixedly secured to the underlying purlins between the opposite ends of the panels by means of the fasteners 25 or the like, and the shear channel or brace 14 secured between an adjacent pair of purlins substantially medially of each panel thus results in rigidification of each section of the roof as defined by each roof panel, but the roof panels are still enabled to move relative to one another to compensate for thermal expansion and contraction.

Figure 8:
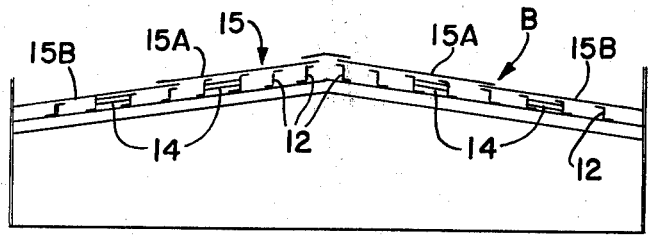
FIG. 8 is a schematic view in elevation showing the relationship of primary and secondary frame members, roof panels and braces according to the invention.

In FIG. 8, the relative positions of roof panels, purlins and braces are shown schematically in elevation. The shear channels or braces are located between purlins at the frame line at approximately the center of each panel length, which is defined as the nominal distance between panel splices or the distance from sidewall structural line to the first panel splice. The panel lengths are uniform along the length of the building, and for a building 130 feet wide and having a double slope, as in FIG. 8, there are four panel lengths across the building, with the panels at the side walls having a length of 35 feet and the panels at the crest or ridge of the roof having a length of 30 feet. Consequently, there are four shear channels spaced across the building at each row of roof panels.

Figure 9:
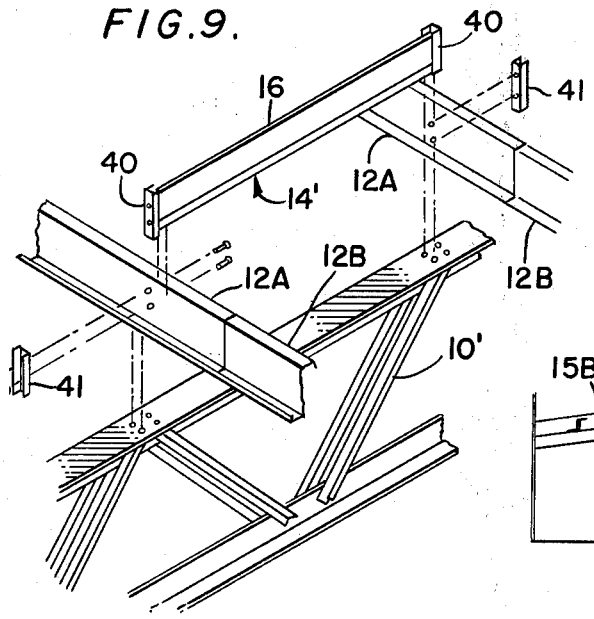
FIG. 9 is an enlarged, fragmentary, perspective view of a modified brace and roof structure.

A modified shear channel or brace 14' is shown in FIG. 9, and in this embodiment, end plates or channels 40 are welded or otherwise suitably fixed to opposite ends of the channel member 16, with opposite ends of channel member 16 extended between the flanges of the channels 40, and back-up channels 41 are disposed on opposite sides of the purlins 12 from the brace 14', and are secured by means of bolts and nuts, or other suitable fastening means. Also, in this figure, a beam truss 10' is shown rather than the beam 10 of FIGS. 1–6.

Figure 10:
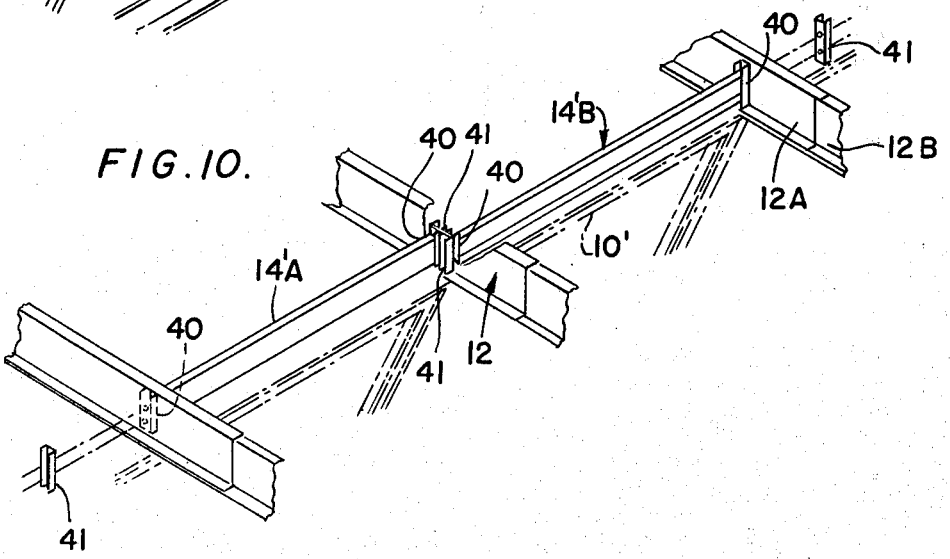
FIG. 10 is an enlarged, fragmentary, perspective view of a further modification of the invention.

A further modification is shown in FIG. 10, wherein a double shear channel or brace configuration is provided, and a pair of shear channels 14'A and 14'B are provided in substantially end-to-end relationship on opposite sides of a purlin 12. This arrangement is necessary for certain building configurations and loading conditions, such as, for example, very long roof panels, or the like. Note also in this figure the overlapped or telescoped relationship of purlins 12A and 12B, which may be necessary in some very large buildings.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A roof structure for a building construction, said building having opposite side walls and opposite end walls, said roof structure having means to assist the building to resist lateral forces imposed on the building, comprising a primary frame means including transversely extending roof beams supported on the side walls, a secondary frame means including a plurality of elongate roof purlins each having a web and being secured on the roof beams substantially transverse to the axes of the roof beams so that said web extends substantially perpendicular to said roof beams, a plurality of roof panels secured on the roof purlins, a plurality of elongate roof brace means each having end faces on the opposite ends thereof which are presented away from each other, each of said end faces being secured to a web of one of a pair of adjacent roof purlins so that each of said brace means is oriented to be substantially perpendicular to the longitudinal axes of the roof purlins, said plurality of brace means each transmitting therethrough compressive forces which are applied thereto via the webs of said adjacent purlins so that said pluralilty of brace means prevent rotation of the roof purlins about their longitudinal axes, and means connecting said purlins to said end walls, said roof thus being rigid and able to transmit compressive forces directed substantially perpendicular to said purlin webs and created by lateral forces imposed on the side walls of the building to the end walls, which act in shear to resist the lateral forces, and means securing the panels to the purlins and to one another, including means at opposite ends of the panels to enable relative movement between the panels to thus enable thermal expansion and contraction of the panels even though said roof structure is rigidified.

2. A roof structure as in claim 1, wherein the building construction is of the pre-engineered, metal type and the roof panels comprise light gauge steel.

3. A roof structure as in claim 2, wherein a plurality of roof panels are connected end-to-end, and said means on adjacent ends of adjacent panels to enable relative movement between the panels due to thermal expansion and contraction of the panels comprises slotted holes in one end of each panel and round holes in the other end thereof, and a roof brace provided substantially medially of each roof panel to thus rigidify the roof structure to resist the lateral forces imposed on the walls of the building and yet enable thermal expansion and contraction of the roof panels relative to one another.

4. A roof structure as in claim 1, wherein said roof panels are secured to a plurality of adjacent purlins.

5. A roof structure as in claim 4, wherein said roof panels are free of direct attachment to the side walls of the building.

6. A roof structure as in claim 4, wherein said purlins are substantially Z-shaped in transverse cross section and the roof braces are substantially channel-shaped in transverse cross section.

7. A roof structure as in claim 6, wherein a rectangular plate is welded to each of the ends of each roof brace and fastening means are extended through the plates and adjacent purlins to secure the braces to the purlins.

8. A roof structure as in claim 1, wherein said roof panels are free of attachment to the side walls and are secured to the end walls, so that lateral forces imposed on the side walls of the building are transferred through the roof panels to the end walls, which act in shear and thus resist the lateral forces.

9. A roof structure as in claim 6, wherein a channel shaped end member is fixed to each end of each roof brace, said end member including a web and a pair of flanges extending perpendicularly from opposite edges thereof, the ends of said roof braces received between said flanges, and fastening means extended through the web of the plates and through adjacent purlins to secure the braces to the purlins.

10. A roof structure for a building having opposite side walls and opposite end walls, wherein the roof transfers lateral forces imposed on the side walls of the building to the end walls thereof, which act in shear to resist the forces, said roof structure comprising a primary frame means including a plurality of elongate roof beams extending between the side walls and fixed at opposite ends thereof to the side walls; a secondary frame means including a plurality of elongate roof purlins each having a web and extending between the end walls and fixed at opposite ends thereof to the end walls, said roof purlins extending on top of the roof beams perpendicularly to the axes of the roof beams and fixed to the roof beams so that said webs extend substantially perpendicular to said roof beams; a plurality of roof panels extending on top of the roof purlins, means connecting said roof panels to the roof purlins, said means including means enabling the roof panels to move a predetermined amount relative to one another and to some of the roof purlins to compensate for thermal expansion and contraction of the roof panels;

means rigidly connecting the endmost roof panels at opposite ends of the building to the building end walls; and an elongate roof brace means having end faces on the opposite ends thereof which are presented away from each other, said brace means extending perpendicular to the axes of the roof purlins with said end faces fixed to webs of a pair of adjacent roof purlins beneath each roof panel to transmit therethrough compressive forces which are applied thereto via the webs of said adjacent purlins so that said brace means rigidifies the roof structure and prevents rotational movement of the roof purlins about their longitudinal axes and thus to enable the roof structure to transfer compressive forces directed substantially perpendicular to said purlin webs and created by lateral loads imposed on the side walls through the primary and secondary frame means and through the roof panels to the shear resisting end walls.

11. A roof structure as in claim 10, wherein each roof brace comprises an elongate channel member having end plate means fixed to opposite ends thereof, a back-up plate disposed on opposite sides of the purlins from the end plate means, and fastening means extended through the back-up plate, purlin and end plate means securing them together.

12. A roof structure as in claim 11, wherein a pair of roof braces are disposed substantially end-to-end on opposite sides of a purlin.

13. A roof structure as in claim 11, wherein the end plate means and back-up plates comprise channel shaped members having a web and a pair of flanges extending perpendicularly from opposite edges thereof, opposite ends of the roof braces received between the flanges of the end plate means, and said fastening means extended through the webs of the end plate means and back-up plates.

* * * * *